US008170218B2

(12) United States Patent
Hurtado-Huyssen

(10) Patent No.: US 8,170,218 B2
(45) Date of Patent: May 1, 2012

(54) MULTI-CHANNEL AUDIO TREATMENT SYSTEM AND METHOD

(76) Inventor: Antoine-Victor Hurtado-Huyssen, Paris (FR)

( * ) Notice: Subject to any disclaimer, the term of this patent is extended or adjusted under 35 U.S.C. 154(b) by 1151 days.

(21) Appl. No.: 11/867,128

(22) Filed: Oct. 4, 2007

(65) Prior Publication Data

US 2009/0092257 A1 Apr. 9, 2009

(51) Int. Cl.
*H04R 5/00* (2006.01)

(52) U.S. Cl. ..... 381/22

(58) Field of Classification Search ..... 381/23, 381/1, 17–22

See application file for complete search history.

(56) References Cited

U.S. PATENT DOCUMENTS

| | | | | |
|---|---|---|---|---|
| 5,638,451 | A | 6/1997 | Sedlmeyer | |
| 7,394,903 | B2 * | 7/2008 | Herre et al. | 381/23 |
| 7,941,320 | B2 * | 5/2011 | Baumgarte et al. | 704/501 |
| 2004/0141619 | A1 | 7/2004 | Schobben | |
| 2006/0262936 | A1 * | 11/2006 | Sato | 381/22 |

FOREIGN PATENT DOCUMENTS

WO WO 2005/036925 4/2005

OTHER PUBLICATIONS

Author: Zielinski, S.K. Tittle: Effects Down-Mix Algorithms on Quality of Surround Sound. Dated: Sep. 2003. Published by AES. vol. 51, No. 9, pp. 780-798.*

Author: Thomas Lund. Tille: Enhanced Localization in 5.1 Production. Preprinted on Sep. 2000 by AES.*

* cited by examiner

*Primary Examiner* — Vivian Chin
*Assistant Examiner* — David Ton
(74) *Attorney, Agent, or Firm* — Ladas & Parry LLP

(57) ABSTRACT

A multi-channel audio treatment method ensuring compatibility of a multi-channel signal and a stereo signal which includes: producing a left-hand downmix channel dwnMxL(t) and a right-hand downmix channel dwnMxR(t); producing a left-hand difference channel deltaL(t), said left-hand difference channel being the difference between the left-hand channel of the stereo signal eStL(t) and the left-hand downmix channel dwnMxL(t); producing a right-hand difference channel deltaR(t), said right-hand difference channel being the difference between the right-hand channel of the stereo signal eStR(t) and the right-hand downmix channel dwnMxR(t); and adding the right hand difference channel deltaR(t) and the left hand difference channel deltaL(t) into the multi-channel signal.

8 Claims, 2 Drawing Sheets

MULTI-CHANNEL AUDIO TREATMENT SYSTEM AND METHOD

FIELD OF THE INVENTION

The present invention relates to a multi-channel audio treatment system and method.

BACKGROUND OF THE INVENTION

To achieve compatibility between a multi-channel system and a stereo technique, U.S. Pat. No. 5,638,451 discloses a transmission and storage method for audio signals. In this prior art method, signals from additional audio channels of the multi-channel audio system are added to the left and right basic signals of the multi-channel audio system, such that two modified stereo signals are created for reproduction via a stereo system.

US 2004/0141619 discloses a method of generating a left modified and a right modified audio signal for a stereo system from multi-channel audio signals with a left and a right channel and at least one further audio channel. In this prior art method, the signal of the channel of higher energy is modified in a filter with a transformation function in a first parallel branch and is modified in a second filter with a reverberation function in a second parallel branch, the modified signals being joined together in a summation unit.

WO2005/036925 discloses an apparatus for processing a multi-channel audio signal in a stereo compatible manner. This prior art apparatus comprises means for providing a first Lc and second Rc downmix channels derived from the original channels, Lc and Rc being defined as follows:

$$Lc=t\cdot(L+aLs+bC)$$

$$Rc=t\cdot(R+aRs+bC)$$

wherein t, a and b are weighted factors smaller than 1, L is an original left channel, C is an original center channel, R is an original right channel, Ls is an original left surround channel and Rs is an original right surround channel.

SUMMARY OF THE INVENTION

A first object of the present invention is a multi-channel audio treatment method ensuring compatibility of a multi-channel signal and a stereo signal, this method comprising

- producing a left-hand downmix channel dwnMxL(t) and a right-hand downmix channel dwnMxR(t);
- producing a left-hand difference channel deltaL(t), said left-hand difference channel being the difference between the left-hand channel of the stereo signal eStL(t) and the left-hand downmix channel dwnMxL(t);
- producing a right-hand difference channel deltaR(t), said right-hand difference channel being the difference between the right-hand channel of the stereo signal eStR(t) and the right-hand downmix channel dwnMxR(t);
- adding the right hand difference channel deltaR(t) and the left hand difference channel deltaL(t) into the multi-channel signal.

Advantageously, adding the right hand difference channel deltaR(t) and the left hand difference channel deltaL(t) into the multi-channel signal comprises producing a mono component of the difference signal $$\text{delta}M(t)=0.5*(\text{delta}L(t)+\text{delta}R(t));$$

producing a stereo component of the difference signal $$\text{delta}S(t)=0.5*(\text{delta}L(t)-\text{delta}R(t))$$

adding said mono component of the difference signal and said stereo component of the difference signal to the multi-channel signal, using adjustment variables.

Advantageously, said left-hand downmix channel dwnMxL(t) is defined as $$dwnMxL(t) = eL(t) + \frac{1}{\sqrt{2}}eC(t) + \frac{1}{\sqrt{2}}eLFE(t) + \frac{1}{\sqrt{2}}esL(t)$$

said right-hand downmix channel dwnMxR(t) being defined as $$dwnMxR(t) = eR(t) + \frac{1}{\sqrt{2}}eC(t) + \frac{1}{\sqrt{2}}eLFE(t) + \frac{1}{\sqrt{2}}esR(t)$$

eL(t) being the left-hand channel of the multi-channel signal eR(t) being the right-hand channel of the multi-channel signal eC(t) being the centre channel of the multi-channel signal eLFE(t) being the sub-bass channel of the multi-channel signal esL(t) being the rear left-hand channel of the multi-channel signal esR(t) being the rear right-hand channel of the multi-channel signal.

Advantageously, adjustment variables are two adjustment variables M, S, having values between 0 and 1, the output multi-channel signal being $$rL(t)=eL(t)+((1-M)*\text{delta}M(t))+(S*\text{delta}S(t))$$

$$rR(t)=eR(t)+((1-M)*\text{delta}M(t))-(S*\text{delta}S(t))$$

$$rC(t)=eC(t)+(\sqrt{2}*M*\text{delta}M(t))$$

$$rLFE(t)=eLFE(t)$$

$$rsL(t)=esL(t)+(\sqrt{2}*(1-S)*\text{delta}S(t))$$

$$rsR(t)=esR(t)+(\sqrt{2}*(S-1)*\text{delta}S(t))$$

wherein eStL(t) is the left-hand channel of the stereo signal eStR(t) is the right-hand channel of the stereo signal A second object of the present invention is a computer program product comprising a computer usable medium having control logic stored therein for causing a computer to ensure compatibility of a multi-channel signal and a stereo signal, said control logic comprising

- first computer readable program code for producing a left-hand downmix channel dwnMxL(t) and a right-hand downmix channel dwnMxR(t);
- second computer readable program code for producing a left-hand difference channel deltaL(t), said left-hand difference channel being the difference between the left-hand channel of the stereo signal eStL(t) and the left-hand downmix channel dwnMxL(t);
- third computer readable program code for producing a right-hand difference channel deltaR(t), said right-hand difference channel being the difference between the right-hand channel of the stereo signal eStR(t) and the right-hand downmix channel dwnMxR(t);

fourth computer readable program code for adding the right hand difference channel deltaR(t) and the left hand difference channel deltaL(t) into the multi-channel signal.

Advantageously, said control logic comprises fifth computer readable program code for producing a mono component of the difference signal $$\text{delta}M(t)=0.5*(\text{delta}L(t)+\text{delta}R(t));$$

and sixth computer readable program code for producing a stereo component of the difference signal $$\text{delta}S(t)=0.5*(\text{delta}L(t)-\text{delta}R(t))$$

said computer program code comprising seventh computer readable program code for adding said mono component of the difference signal and said stereo component of the difference signal to the multi-channel signal, using adjustment variables.

Advantageously, said control logic comprises eight computer readable program code for producing said left-hand downmix channel dwnMxL(t) has defined as $$dwnMxL(t) = eL(t) + \frac{1}{\sqrt{2}}eC(t) + \frac{1}{\sqrt{2}}eLFE(t) + \frac{1}{\sqrt{2}}esL(t)$$

and said right-hand downmix channel dwnMxR(t) has defined as $$dwnMxR(t) = eR(t) + \frac{1}{\sqrt{2}}eC(t) + \frac{1}{\sqrt{2}}eLFE(t) + \frac{1}{\sqrt{2}}esR(t)$$

eL(t) being the left-hand channel of the multi-channel signal eR(t) being the right-hand channel of the multi-channel signal eC(t) being the centre channel of the multi-channel signal eLFE(t) being the sub-bass channel of the multi-channel signal esL(t) being the rear left-hand channel of the multi-channel signal esR(t) being the rear right-hand channel of the multi-channel signal.

Advantageously, adjustment variables are two adjustment variables M, S, having values between 0 and 1, said control logic comprising computer readable program code for producing the following output multi-channel signal $$rL(t)=eL(t)+((1-M)*\text{delta}M(t))+(S*\text{delta}S(t))$$

$$rR(t)=eR(t)+((1-M)*\text{delta}M(t))-(S*\text{delta}S(t))$$

$$rC(t)=eC(t)+(\sqrt{2}*M*\text{delta}M(t))$$

$$rLFE(t)=eLFE(t)$$

$$rsL(t)=esL(t)+(\sqrt{2}*(1-S)*\text{delta}S(t))$$

$$rsR(t)=esR(t)+(\sqrt{2}*(S-1)*\text{delta}S(t))$$

wherein eStL(t) is the left-hand channel of the stereo signal eStR(t) is the right-hand channel of the stereo signal A third object of the present invention is a multi-channel audio treatment device ensuring compatibility of a multi-channel signal and a stereo signal, comprising means for producing a left-hand downmix channel dwnMxL(t) and a right-hand downmix channel dwnMxR(t);

means for producing a left-hand difference channel deltaL(t), said left-hand difference channel being the difference between the left-hand channel of the stereo signal eStL(t) and the left-hand downmix channel dwnMxL(t);

means for producing a right-hand difference channel deltaR(t), said right-hand difference channel being the difference between the right-hand channel of the stereo signal eStR(t) and the right-hand downmix channel dwnMxR(t);

means for adding the right hand difference channel deltaR(t) and the left hand difference channel deltaL(t) into the multi-channel signal.

Advantageously, the device comprises means for producing a mono component of the difference signal deltaM(t)=0.5*(deltaL(t)+deltaR(t)), means for producing a stereo component of the difference signal deltaS(t)=0.5*(detaL(t)−deltaR(t)) and means for adding said mono component of the difference signal and said stereo component of the difference signal to the multi-channel signal, using adjustment variables.

Advantageously, the device comprises means for producing left-hand downmix channel dwnMxL(t) defined as $$dwnMxL(t) = eL(t) + \frac{1}{\sqrt{2}}eC(t) + \frac{1}{\sqrt{2}}eLFE(t) + \frac{1}{\sqrt{2}}esL(t)$$

said device comprising means for producing right-hand downmix channel dwnMxR(t) defined as $$dwnMxR(t) = eR(t) + \frac{1}{\sqrt{2}}eC(t) + \frac{1}{\sqrt{2}}eLFE(t) + \frac{1}{\sqrt{2}}esR(t)$$

eL(t) being the left-hand channel of the multi-channel signal eR(t) being the right-hand channel of the multi-channel signal eC(t) being the centre channel of the multi-channel signal eLFE(t) being the sub-bass channel of the multi-channel signal esL(t) being the rear left-hand channel of the multi-channel signal esR(t) being the rear right-hand channel of the multi-channel signal. adjustment variables being two adjustment variables M, S, having values between 0 and 1, said device comprising means for producing output multi-channel $$rL(t)=eL(t)+((1-M)*\text{delta}M(t))+(S*\text{delta}S(t))$$

$$rR(t)=eR(t)+((1-M)*\text{delta}M(t))-(S*\text{delta}S(t))$$

$$rC(t)=eC(t)+(\sqrt{2}*M*\text{delta}M(t))$$

$$rLFE(t)=eLFE(t)$$

$$rsL(t)=esL(t)+(\sqrt{2}*(1-S)*\text{delta}S(t))$$

$$rsR(t)=esR(t)+(\sqrt{2}*(S-1)*\text{delta}S(t))$$

wherein eStL(t) is the left-hand channel of the stereo signal eStR(t) is the right-hand channel of the stereo signal.

The above and other objects and advantages of the invention will become apparent from the detailed description of preferred embodiments, considered in conjunction with the accompanying drawings.

DESCRIPTION OF PREFERRED EMBODIMENTS

Figure 1:
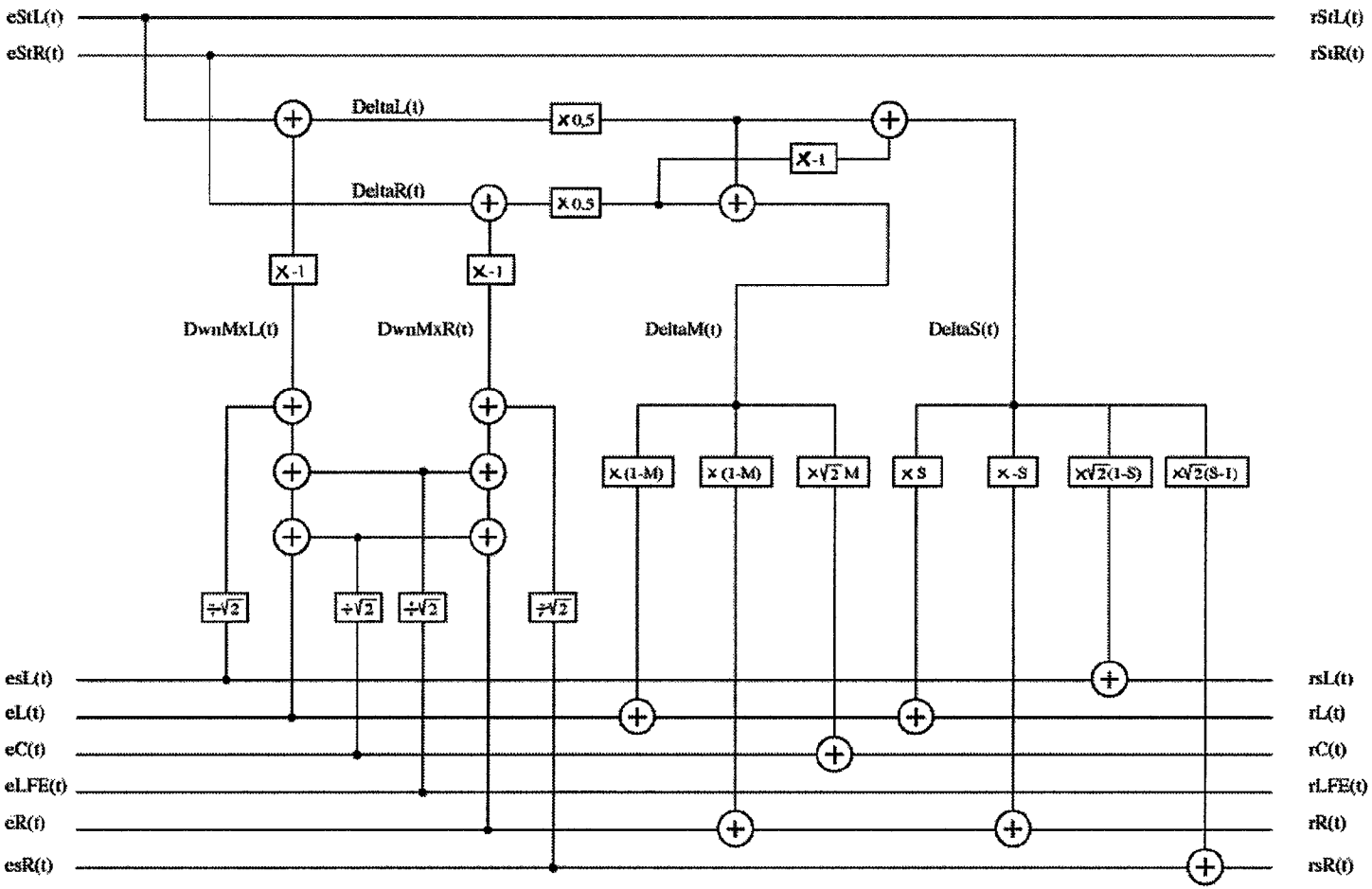
FIG. 1 is a schematic block diagram for the process.
Figure 2:
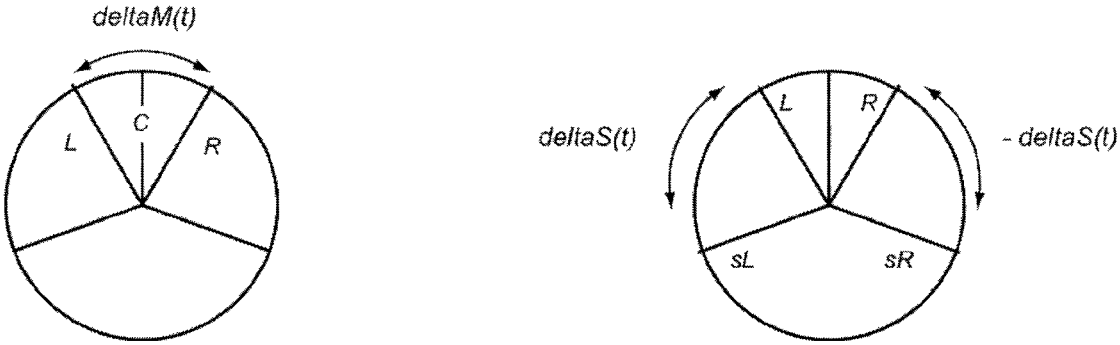
FIG. 2 represents graphically the effect of the adjustment variable

Consider an audio programme (radio broadcast, soundtrack for an audio-visual programme, etc.) being presented in two formats: on the one hand, stereo, and on the other, multi-channel.

The process according to the invention acts in such a manner that the two formats produce the same audio results when reproduced on stereophonic and monophonic receivers.

To ensure this compatibility of the multi-channel format with the stereo and mono formats, the stereo downmix from the multi-channel signals must be equal to the original stereo format signal. To achieve this, the process according to the invention determines the difference between the original stereo signal and the stereo downmix from the multi-channel signal, and this difference, obtained by subtraction, is then added into the multi-channel signal. The addition of this difference into the multi-channel signal ensures mathematically a downmix of the multi-channel signal that is identical to the stereo signal.

The process according to the invention is characterized by the method of adding the difference signal into the multi-channel signal, on two points in particular: on the one hand, the process separates the mono component and the stereo component of the difference signal in order to add them independently into the multi-channel signal channels; on the other hand, the process offers two adjustment variables to control this addition into the various channels of the multi-channel signal.

The mathematical description of the process can be established as follows:

The input channels are:

eStL(t), the left-hand channel of the stereo signal eStR(t), the right-hand channel of the stereo signal eL(t), the left-hand channel of the multi-channel signal eR(t), the right-hand channel of the multi-channel signal eC(t), the centre channel of the multi-channel signal eLFE(t), the sub-bass channel of the multi-channel signal esL(t), the rear left-hand channel of the multi-channel signal esR(t), the rear right-hand channel of the multi-channel signal.

The left-hand downmix channel is defined as:

$$dwnMxL(t) = eL(t) + \frac{1}{\sqrt{2}}eC(t) + \frac{1}{\sqrt{2}}eLFE(t) + \frac{1}{\sqrt{2}}esL(t)$$

The right-hand downmix channel is defined as:

$$dwnMxR(t) = eR(t) + \frac{1}{\sqrt{2}}eC(t) + \frac{1}{\sqrt{2}}eLFE(t) + \frac{1}{\sqrt{2}}esR(t)$$

The difference signal channels are the left-hand channel of the difference signal deltaL(t) and the right-hand channel of the difference signal deltaR(t) as defined below:

$$\text{delta}L(t)=eStL(t)-dwnMxL(t)$$

$$\text{delta}R(t)=eStR(t)-dwnMxR(t)$$

The MS format conversion of the difference signal is:
the mono component of the difference signal $$\text{delta}M(t)=0.5*(\text{delta}L(t)+\text{delta}R(t)),$$

the stereo component of the difference signal $$\text{delta}S(t)=0.5*(\text{delta}L(t)-\text{delta}R(t))$$

the stereo component of the difference signal $$\text{delta}S(t)=0.5*(\text{delta}L(t)-\text{delta}R(t))$$

The adjustment variables control the distribution of the mono and stereo components of the difference signal. The value of these variables is between 0 and 1.

Adjustment variable 'M' distributes the monophonic component between the C(t) and L(t)/R(t) channels of the multi-channel signal.

Adjustment variable 'S' distributes the stereo component between the L(t)/R(t) and sL(t)/sR(t) channels of the multi-channel signal.

The output multi-channel signal is then:

$$rL(t)=eL(t)+((1-M)*\text{delta}M(t))+(S*\text{delta}S(t))$$

$$rR(t)=eR(t)+((1-M)*\text{delta}M(t))-(S*\text{delta}S(t))$$

$$rC(t)=eC(t)+(\sqrt{2}*M*\text{delta}M(t))$$

$$rLFE(t)=eLFE(t)$$

$$rsL(t)=esL(t)+(\sqrt{2}*(1-S)*\text{delta}S(t))$$

$$rsR(t)=esR(t)+(\sqrt{2}*(S-1)*\text{delta}S(t))$$

and in the case where the adjustment variables are not being applied (M=1, S=1), the output signal is then:

$$rL(t)=eL(t)+\text{delta}S(t)$$

$$rR(t)=eR(t)-\text{delta}S(t)$$

$$rC(t)=eC(t)+(\sqrt{2}*\text{delta}M(t))$$

$$rLFE(t)=eLFE(t)$$

$$rsL(t)=esL(t)$$

$$rsR(t)=esR(t)$$

The stereo signal remains unchanged.

$$rStL(t)=eStL(t)$$

$$rStR(t)=eStR(t)$$

The invention claimed is:

1. A multi-channel audio treatment method ensuring compatibility of a multi-channel signal and a stereo signal, comprising:

producing a left-hand downmix channel dwnMxL(t) and a right-hand downmix channel dwnMxR(t);

producing a left-hand difference channel deltaL(t), said left-hand difference channel being the difference between the left-hand channel of the stereo signal eStL (t) and the left-hand downmix channel dwnMxL(t);

producing a right-hand difference channel deltaR(t), said right-hand difference channel being the difference between the right-hand channel of the stereo signal eStR (t) and the right-hand downmix channel dwnMxR(t); and adding the right hand difference channel deltaR(t) and the left hand difference channel deltaL(t) into the multi-channel signal.

2. A multi-channel audio treatment method according to claim 1, wherein adding the right hand difference channel deltaR(t) and the left hand difference channel deltaL(t) into the multi-channel signal comprises:

producing a mono component of the difference signal $$\text{delta}M(t)=0.5*(\text{delta}L(t)+\text{delta}R(t));$$

producing a stereo component of the difference signal $$\text{delta}S(t)=)=0.5*(\text{delta}L(t)-\text{delta}R(t)); \text{ and}$$

adding said mono component of the difference signal and said stereo component of the difference signal to the multi-channel signal, using adjustment variables.

3. A multi-channel audio treatment method according to claim 1 or 2, wherein said left-hand downmix channel dwnMxL(t) is defined as $$dwnMxL(t) = eL(t) + \frac{1}{\sqrt{2}}eC(t) + \frac{1}{\sqrt{2}}eLFE(t) + \frac{1}{\sqrt{2}}esL(t),$$

said right-hand downmix channel dwnMxR(t) being defined as $$dwnMxR(t) = eR(t) + \frac{1}{\sqrt{2}}eC(t) + \frac{1}{\sqrt{2}}eLFE(t) + \frac{1}{\sqrt{2}}esR(t), \quad \text{wherein}$$

eL(t) being the left-hand channel of the multi-channel signal, eR(t) being the right-hand channel of the multi-channel signal, eC(t) being the centre channel of the multi-channel signal, eLFE(t) being the sub-bass channel of the multi-channel signal, esL(t) being the rear left-hand channel of the multi-channel signal, and esR(t) being the rear right-hand channel of the multi-channel signal.

4. A multi-channel audio treatment method according to claim 3, wherein adjustment variables are two adjustment variables M, S, having values between 0 and 1, the output multi-channel signal being $$rL(t)=eL(t)+((1-M)*\text{delta}M(t))+(S*\text{delta}S(t)),$$

$$rR(t)=eR(t)+((1-M)*\text{delta}M-(t))-(S*\text{delta}S(t)),$$

$$rC(t)=eC(t)+(\sqrt{2}*M*\text{delta}M(t)),$$

$$rLFE(t)=eLFE(t),$$

$$rsL(t)=esL(t)+(\sqrt{2}*(1-S)*\text{delta}S(t)), \text{ and}$$

$$rsR(t)=esR(t)+(\sqrt{2}*(S-1)*\text{delta}S(t)),$$

wherein eStL(t) is the left-hand channel of the stereo signal, and eStR(t) is the right-hand channel of the stereo signal.

5. A non-transient computer readable storage medium having control logic stored therein for causing a computer to ensure compatibility of a multi-channel signal and a stereo signal, said control logic comprising:

a first computer readable program code for producing a left-hand downmix channel dwnMxL(t) and a right-hand downmix channel dwnMxR(t);

a second computer readable program code for producing a left-hand difference channel deltaL(t), said left-hand difference channel being the difference between the left-hand channel of the stereo signal eStL(t) and the left-hand downmix channel dwnMxL(t);

a third computer readable program code for producing a right-hand difference channel deltaR(t), said right-hand difference channel being the difference between the right-hand channel of the stereo signal eStR(t) and the right-hand downmix channel dwnMxR(t); and a fourth computer readable program code for adding the right hand difference channel deltaR(t) and the left hand difference channel deltaL(t) into the multi-channel signal.

6. The non-transient computer readable storage medium according to claim 5, wherein said control logic comprises a fifth computer readable program code for producing a mono component of the difference signal comprising $$\text{delta}M(t)=0.5*(\text{delta}L(t)+\text{delta}R(t));$$

a sixth computer readable program code for producing a stereo component of the difference signal comprising $$\text{delta}S(t)=0.5*(\text{delta}L(t)-\text{delta}R(t)); \text{ and}$$

a seventh computer readable program code for adding said mono component of the difference signal and said stereo component of the difference signal to the multi-channel signal, using adjustment variables.

7. The non-transient computer readable storage medium according to claim 6, wherein said control logic comprises eight computer readable program code for producing said left-hand downmix channel dwnMxL(t) defined as $$dwnMxL(t) = eL(t) + \frac{1}{\sqrt{2}}eC(t) + \frac{1}{\sqrt{2}}eLFE(t) + \frac{1}{\sqrt{2}}esL(t),$$

and said right-hand downmix channel dwnMxR(t) defined as $$dwnMxR(t) = eR(t) + \frac{1}{\sqrt{2}}eC(t) + \frac{1}{\sqrt{2}}eLFE(t) + \frac{1}{\sqrt{2}}esR(t), \quad \text{wherein}$$

eL(t) being the left-hand channel of the multi-channel signal, eR(t) being the right-hand channel of the multi-channel signal, eC(t) being the centre channel of the multi-channel signal, eLFE(t) being the sub-bass channel of the multi-channel signal, esL(t) being the rear left-hand channel of the multi-channel signal, and esR(t) being the rear right-hand channel of the multi-channel signal.

8. The non-transient computer readable storage medium according to claim 7, wherein adjustment variables are two adjustment variables M, S, having values between 0 and 1, said control logic comprising computer readable program code for producing the following output multi-channel signal that comprises:

$$rL(t)=eL(t)+((1-M)*\text{delta}M(t))+(S*\text{delta}S(t)),$$

$$rR(t)=eR(t)+((1-M)*\text{delta}-M(t))-(S*\text{delta}S(t)),$$

$$rC(t)=eC(t)+(\sqrt{2}*M*\text{delta}M(t)),$$

$$rLFE(t)=eLFE(t),$$

$$rsL(t)=esL(t)+(\sqrt{2}*(1-S)*\text{delta}S(t)), \text{ and}$$

$$rsR(t)=esR(t)+(\sqrt{2}*(1-S)*\text{delta}S(t)),$$

wherein eStL(t) is the left-hand channel of the stereo signal, and eStR(t) is the right-hand channel of the stereo signal.

* * * * *